US005254441A

United States Patent [19]

Pearce et al.

[11] Patent Number: 5,254,441

[45] Date of Patent: Oct. 19, 1993

[54] DEVELOPMENT INHIBITOR REFLECTOR LAYERS

[75] Inventors: Glenn T. Pearce, Fairport; Elizabeth V. Patton, Pittsford; Michael R. Roberts, Rochester; Ignazio S. Ponticello, Pittsford; George Villard, Rochester; Susan C. Gross, deceased, late of Rochester, all of N.Y.; Marjorie M. Datskow, executrix, Lafayett Hill, Pa.

[73] Assignee: Eastman Kodak Company, Rochester, N.Y.

[21] Appl. No.: 771,030

[22] Filed: Oct. 1, 1991

[51] Int. Cl.[5] ..... G03C 1/34; G03C 1/46; G03C 7/26

[52] U.S. Cl. ..... 430/382; 430/505; 430/536; 430/544; 430/545; 430/957

[58] Field of Search ..... 430/214, 215, 219, 505, 430/544, 545, 382, 957, 536

[56] References Cited

U.S. PATENT DOCUMENTS

| | | | |
|---|---|---|---|
| 2,555,646 | 6/1951 | Jones | 260/65 |
| 3,455,686 | 7/1969 | Farney et al. | 96/3 |
| 3,576,628 | 8/1971 | Beavers | 96/29 |
| 3,706,557 | 12/1972 | Arond | 430/219 |
| 3,765,893 | 10/1973 | Lohmer | 96/74 |
| 3,819,379 | 6/1974 | Ohyama et al. | 430/544 |
| 3,867,152 | 2/1975 | Priem et al. | 96/63 |
| 3,888,669 | 6/1975 | Cardone | 96/3 |
| 3,984,245 | 10/1976 | Hirose | 96/74 |
| 4,055,429 | 10/1977 | Holmes et al. | 96/74 |
| 4,088,499 | 5/1978 | Brust et al. | 96/29 D |
| 4,214,047 | 7/1980 | Chen | 430/448 |
| 4,248,962 | 2/1981 | Lau | 430/544 |
| 4,317,892 | 3/1982 | Abel | 252/194 |
| 4,396,706 | 8/1983 | Ishii et al. | 430/403 |
| 4,440,848 | 4/1984 | Bailey et al. | 430/215 |
| 4,504,569 | 3/1985 | Abel et al. | 430/214 |
| 4,575,841 | 3/1986 | Takahashi et al. | 430/215 |
| 4,722,885 | 2/1988 | Yokoyama et al. | 430/215 |
| 4,822,727 | 4/1989 | Ishigaki et al. | 430/536 |
| 4,865,946 | 9/1989 | Bowman et al. | 430/215 |

FOREIGN PATENT DOCUMENTS

| | | |
|---|---|---|
| 0073763 | 3/1983 | European Pat. Off. . |
| 0271797 | 6/1988 | European Pat. Off. . |
| 0358187 | 9/1989 | European Pat. Off. . |
| 2331817 | 11/1976 | France . |
| 61-236542 | 4/1985 | Japan . |
| 1-304460 | 2/1990 | Japan . |
| 1466600 | 3/1977 | United Kingdom . |
| 91/15526 | 10/1991 | World Int. Prop. O. . |

OTHER PUBLICATIONS

Research Disclosure 19551, Jul. 1980, Disclosed anonymously, pp. 301-310.

*Primary Examiner*—Richard L. Schilling
*Attorney, Agent, or Firm*—Sarah Meeks Roberts

[57] ABSTRACT

This invention provides a photographic element containing a polymer layer which reflects a development inhibitor or its precursor released from a DIR compound thereby retarding the diffusion of the development inhibitor to another layer. The polymers used in the barrier layer contain from about $1\times10^{-5}$ to about $4\times10^{-3}$ ion forming functional groups. The preferred polymers comprise repeating units of the formula $-(A)_m-(B)_n-$ with A derived from a hydrophobic monomer and B derived from an ionic hydrophilic monomer with the more preferred monomers being acrylates, methacrylates, acrylamides and methacrylamides. The invention also provides a method of processing a photographic element containing such a barrier layer.

18 Claims, No Drawings

DEVELOPMENT INHIBITOR REFLECTOR LAYERS

BACKGROUND OF THE INVENTION

This invention is related to copending, commonly assigned U.S. application Ser. No. 502,726. filed Apr. 2, 1990. It is also related to copending, commonly assigned U.S. application Ser. No. 771,016, Szajewski, et al. entitled Photographic Silver Halide Material with Improved Color Saturation filed concurrently.

This invention relates to a photographic element containing a barrier layer. The invention more specifically relates to a barrier layer which will reflect a development inhibitor or precursor released in another layer in the photographic element to prevent the migration of the development inhibitor.

It is known in the photographic art to use development inhibitor releasing compounds in photographic elements to selectively control the development of silver halide emulsion layers. The use of these compounds can result in desirable improvements in sensitometry and image structure by reducing contrast and introducing intralayer and interlayer development effects. The release of these inhibitors upon development can reduce the granularity and enhance the sharpness of the image. The use of development inhibitor releasing couplers which react with the oxidation product of a color developing agent to release a development inhibiting fragment is described in U.S. Pat. Nos. 4,782,012, 4,477,563 and 4,248,962.

It is well known that excessive migration of a development inhibitor from the emulsion layer from which it is released can detrimentally affect the processing of other silver halide emulsion layers in the same photographic element or in subsequently processed photographic elements. For example, intralayer migration of a released development inhibitor can provide improved sharpness and reduced contrast and granularity, at the same time, interlayer migration of the development inhibitor may provide more interimage effect than is desired.

Another serious problem involving the wandering of development inhibitors is that they can diffuse into the developing solution from the photographic element and undesirably "season" the developing solution. Thus, the concentration of development inhibitor is built up in the developing solution, and the sensitometry of subsequently processed film is affected in a non-imagewise manner.

It is known to include in photographic materials scavenger layers for the released development inhibitors to help prevent unwanted interlayer diffusion. Such scavenger layers include the use of Lippmann emulsions in layers above, between or under image forming emulsion layers to inhibit development inhibitors from migrating either between layers or from the element to the developing solution. Other inhibitor adsorbing layers are described in U.S. Pat. Nos. 3,984,245 and 4,055,429. The use of fine grain silver halide layers, however, has been found to sometimes alter the sensitometry of the image-forming layers adjacent thereto. The use of interlayer formulations which adsorb the development inhibitor may require the use of a higher concentration of the inhibitor releasing compound to provide the desired intralayer effect.

U.S. Pat. No. 4,504,569 suggests the use of a N-alkyl substituted acrylamide with a defined solubility parameter as a temporary barrier layer between reactants such as developing solutions and development restrainers. The polymers described however, are timing layers and are used in color image transfer film units. Such timing layers are not used in photographic materials intended for traditional processing because they will prevent the diffusion of processing solutions until the timing layer breaks down thus unnecessarily slowing down the processing.

The need exists, therefore, for an improved means of allowing the enhancement of intralayer effects achieved through the use of development inhibitors while at the same time controlling undesired interlayer effects.

SUMMARY OF THE INVENTION

This invention provides a solution to the problem by using in a photographic element containing a DIR compound a polymer layer which acts as a reflective barrier to the diffusion of the development inhibitors while allowing the diffusion of processing solutions. The polymers reflect the development inhibitors rather than scavenging or absorbing them. Reflection rather than absorption of development inhibitors controls the undesired interlayer effects caused by the diffusion of development inhibitors while enhancing the intralayer effects. It also reduces the required loading of DIR compounds.

Thus, in accordance with an embodiment of this invention, there is provided a photographic element comprising at least one silver halide emulsion layer in reactive association with a DIR compound and at least one layer comprising a polymer containing from about $1\times10^{-5}$ to about $4\times10^{-3}$ moles/gram of ion forming functional groups. More preferably the polymer contains about $5\times10^{-5}$ to about $2\times10^{-3}$ moles/gram of ion forming functional groups and the preferred polymer is cationic. The more preferred polymer is derived from ethylenically unsaturated monomers and most preferably is comprised of repeating units derived from any hydrophobic acrylate, methacrylate, acrylamide or methacrylamide monomer and repeating units from any ionic hydrophilic acrylate, methacrylate, acrylamide or methacrylamide monomer. Another embodiment of this invention provides a method of forming a photographic image by developing the photographic element containing the herein described barrier or polymer layers.

Additionally, the polymer may be further comprised of repeating units derived from hydrophilic non-ionic monomers provided the polymer contains at least $1\times10^{-5}$ moles/gram of ion forming functional groups. The polymer layer may also comprise 0% to 25% of gelatin. Additionally the polymer layer may be associated with a surfactant or surfactant-like compound, preferrably one of opposite charge to the polymer.

DETAILED DESCRIPTION OF THE INVENTION

The polymers of this invention can be used as barrier layers to development inhibitors or their precursors which are released by DIR compounds. A DIR compound is a molecule capable of releasing a development inhibitor during photographic processing.

The polymers of this invention contain ion forming functional groups in amounts from about $1\times10^{-5}$ to about $4\times10^{-3}$ moles/gram of polymer and preferably from about $5\times10^{-5}$ to about $2\times10^{-3}$ moles/gram of polymer. Additionally, the polymers of this invention do not contain groups which may absorb, scavenge or mordant development inhibitors, for example, secondary, tertiary or quaternary ammonium groups. The polymers should contain a balance of hydrophobic and hydrophilic entities such that they are swellable, but not fully soluble in water or processing solutions as coated. They should also allow the passage of processing solutions, either when coated alone or in combination with gelatin. Further, they should be dispersible or soluble in water as formulated for coating. The preferred polymers are cationic. The molecular weight of the polymers must be such that they are practical to coat, and is preferably 50,000 to 1,000,000.

The polymers may contain repeating units derived from any monomers which can be used in photographic elements provided the resulting polymer meets the ionic content requirement defined above and has the correct water swellability in the processing solutions. These can include, among others, water dispersible polyesters, polyamides, polyethers, polysulfones, polyurethanes, polyphosphazenes, and chemically modified naturally-occurring polymers such as proteins, polysaccharides, and chitins. Preferred monomers are vinyl monomers particularly acrylate, methacrylate, acrylamide and methacrylamide monomers which includes analogs of said monomers.

The more preferred polymers contain repeating units of the formula —(A)—(B)— wherein A is a hydrophobic ethylenically unsaturated monomer and B is an ionic hydrophilic ethylenically unsaturated monomer. A may be selected from, for example, vinyl ketones, alkylvinyl esters and ethers, styrene, alkylstyrenes, halostyrenes, acrylonitrile, butadiene, isoprene, chloroprene, ethylene and alkylsubstituted ethylenes, haloethylenes, and vinylidene halides. Examples of hydrophobic monomers are listed in *Research Disclosure* No. 19551, p. 301, Jul., 1980 hereby incorporated by reference. B may be selected from any class of vinyl monomers having an ion forming functional group and that can undergo free radical polymerization, for example, itaconic and fumaric acids, vinyl ketones, N-vinyl amides, vinyl sulfones, vinylethers, vinylesters, vinyl urylenes, vinyl urethanes, vinyl nitriles, vinylanhydrides, allyl amine, maleic anyhdride, maleimides, vinylimides, vinylhalides, vinyl aldehydes, substituted styrenes, and vinyl heterocycles. Other examples of ionic monomers are listed in *Research Disclosure* No. 19551, p. 303, Jul. 1980 hereby incorporated by reference. The more preferred monomers of group A and B are acrylamides, methacrylamides, acrylates and methacrylates.

The ion forming functional groups of B may be ionic groups, ion forming functional groups or groups which can undergo a subsequent reaction resulting in the formation of an ionic group, e.g. by hydrolysis or by pH induced protonation. Any ion forming functional group will work in this invention provided its presence augments the water swellability of the polymer during processing. Suitable ion forming groups will be apparent to those skilled in the art. The ion forming groups can be either cationic or anionic and the polymers may contain monomers with opposite charges such that the polymers are zwitterionic.

Particularly useful are polymers containing repeating units derived from ethylenically unsaturated monomers of the formula $-(A)_m-(B)_n-$.

A is a hydrophobic monomer having the structure

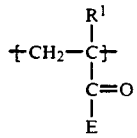

where $R^1$ is —H or —$CH_3$;

E is —$OR^2$ or —$NR^3R^4$;

$R^2$ is a substituted or unsubstituted straight, branched, or cyclic alkyl or aryl group of about 1 to 10 carbon atoms;

$R^3$ and $R^4$ are independently selected from H or any $R^2$ group and $R^3$ and $R^4$ together contain at least 3 carbon atoms; and m is 0 to 99.5 mole %.

B is an ionic hydrophilic monomer of the formula:

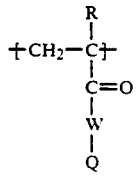

wherein

R is —H or —$CH_3$;

W is —$OR^5$— or —$NR^6R^7$—;

$R^5$ is a straight, branched, or cyclic alkylene or arylene group of 1 to about 10 carbon atoms;

$R^6$ is —H or a straight, branched, or cyclic alkyl or aryl group from 1 to about 6 carbon atoms;

$R^7$ is a straight, branched or cyclic alkylene or arylene group of 1 to about 10 carbon atoms, n is 0.5 to 100 mole %; and Q is an ion forming functional group independently selected from:

a) —$NH_2$ or the acid addition salt —$NH_2$:HX, where X is an appropriate acid anion or b) —$CO_2M$,—$SO_3M$,—$OSO_3M$,—$OPO_3M$, and —OM and M is an appropriate cation.

When the polymers of this invention are derived from monomers A and B of the above formula and both A and B are acrylamide or methacrylamide monomers monosubstituted on the amide nitrogen the polymers fall within a class of polymers known as Thermo Reversible Gelling (TRG) polymers. The TRG polymers are one preferred class of polymers in this invention and are described in detail in U.S. application Ser. No. 502,726 filed Apr. 2, 1990, hereby incorporated by reference. Any TRG polymer as described in the above application is included in this invention providing it falls within the parameters described herein.

$R^2$, $R^3$, and $R^4$ of formula A may be substituted with any non-ion forming group that does not interfere with the hydrophobic nature of the monomer or prevent polymerization. Examples of substituents are halide, alkoxy, acryloxy, styryl, sulfoxyalkyl, sulfoalkyl, nitro, thio, keto, or nitrile groups. The monomers of group A may also contain reactive functional groups so that the polymers may perform other photographically useful functions common to interlayers between imaging layers. $R^2$, $R^3$, $R^4$ $R^5$, $R^6$ and $R^7$ may be substituted with groups that can form heterocyclic rings. The straight, branched or cyclic alkyl groups of A and B include all isomeric forms and may contain one or more sites of unsaturation. The more preferred monomers of group A contain unsubstituted straight or branched alkyl groups of 4 to 8 carbon atoms and the more preferred monomers of group B contain straight or branched alkyl groups of 3 to 8 carbon atoms. The most preferred monomers of both A and B are acrylamides or methacrylamides monosubstituted on the amide nitrogen. For the polymers of this invention m is 0 to about 99.5 mole % and n is about 0.5 to 100 mole %. When the polymer is a TRG polymer m is preferably about 40 to 99 mole % and n is preferably about 1 to about 60 mole %.

The acid ions and cations of Q may be organic or inorganic. Appropriate anions include, but are not limited to, $Cl^-$, $Br^-$, $ClO_4^-$, $I^-$, $F^-$, $NO^-$, $HSO_4^-$, $SO_4^=$, $HCO_3^-$, and $CO_3^=$ with $Cl^-$ being most preferred. Appropriate cations include, but are not limited to, $H^+$, alkali metal and ammonium, with $Na^+$ and $H^+$ being most preferred.

Examples of preferred monomers from group A are N-isopropylacrylamide, N-t-butylacrylamide, N-butylacrylamide, N-t-butylmethacrylamide, N-(1,1-dimethyl-3-oxobutyl)-acrylamide, N-butylmethacrylate, 2-ethyl-hexylmethacrylate and benzylmethacrylate. Examples of preferred monomers from group B are N-(3-aminopropyl)methacrylamide hydrochloride, aminoethylmethacrylate hydrochloride, sulfo-ethyl methacrylate sodium salt, N-(2-sulfo-1, 1-dimethylethyl)acrylamide sodium salt and N-2-carboxyethylacrylamide.

The polymers of this invention may also include repeating units derived from hydrophilic nonionic monomers to enhance their water swellability and to increase their permeability to processing solutions provided that ionic functional groups continue to comprise at least $1\times10^{-5}$ moles/gram of polymer. Any hydrophilic monomer that will undergo free radical polymerization is suitable provided it does not contain secondary, tertiary or quaternary ammonium groups. Preferred monomers are ethylenically unsaturated monomers, for example, N-vinyl pyrrolidone, N-vinyl-ecaprolactam, vinyloxazoldone, vinyl mentyloxazolidone, maleimide, N-methylolmaleimide, maleic anhydride, N-vinylsuccinamide, acryloylurea, cyanomethylacrylate, 2-cyanoethyl acrylate, glycerylacrylate, acryloyloxypolyglycerol, allylalcohol, vinyl benzylalcohol, p-methanesulfonamidostyrene, and methylvinylether. Block copolymers formed from, for example, polymethylene oxide, polypropylene oxide, and polyurethanes, with acrylate or methacrylate end groups can also be used. The more preferred monomers are acrylate, methacrylate, acrylamide and methacrylamide monomers and their analogs.

Representative monomers include N-(isobutoxymethyl)acrylamide, methyl-2-acrylamide-2-methoxy acetate, N-hydroxypropylacrylamide, ethylacrylamidoacetate, N-acetamidoacrylamide, N-(m-hydroxyphenyl)-acrylamide, 2-acrylamide-2-hydroxymethyl-1,3-propane diol, and N-(3 or 5-hydroxymethyl,2-methyl-4-oxo-2-pentyl)acrylamide. Other suitable hydrophilic monomers are listed in *Research Disclosure* No. 19551, p.305, Jul., 1980 hereby incorporated by reference. Examples of preferred hydrophilic non-ionic monomers are acrylamide, methylacrylamide, N,N dimethylacrylamide, hydroxyethylacrylamide, hydroxyethyl acrylate and methacrylate, hydroxypropyl acrylate and methacrylate, and methylene-bis-acrylamide. The hydrophilic nonionic monomer may be 0 to about 70 mole % and preferably about 10 to 65 mole %.

The polymer layers must also have enough physical integrity to survive processing intact. Those skilled in the art will recognize that many of the monomers discussed above contain structural elements that will meet this parameter. For example polymers containing the cationic hydrophilic monomer N-(3-aminopropyl)methacrylamide hydrochloride also crosslink in the presence of many gelatin hardeners. Polymers of this invention, however, may also contain additional monomers having groups which can be crosslinked by conventional photographic gelatin hardeners. These monomers can include, but are not limited to, aldehydes, bis(vinylsulfonyl)compounds, epoxides, aziridines, isocyanates and carbodimides. Preferred are monomers containing active methylene groups such as 2-acetoacetoxyethylmethacrylate, ethylmethacryloylacetoacetate, and N-2-acetoacetoxyethyl)acrylamide. Alternatively, di or multi-functional monomers such as methylene-bis-acrylamide or ethylene glycol-dimethacrylate may be used, whereby polymers are prepared as crosslinked colloidal particles that are swellable and dispersible in water.

Polymer examples of this invention were comprised of monomers whose structures are shown below, and are listed in table 1 which provides the monomer feed ratios used, charge type, and also indicates which of the polymers are of the preferred TRG class.

HYDROPHOBIC MONOMERS

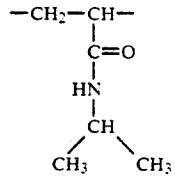

N-Isopropylacrylamide (IPA)

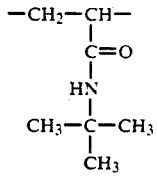

N-t-butylacrylamide (TBA)

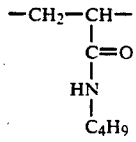

N-butylacrylamide (NBA)

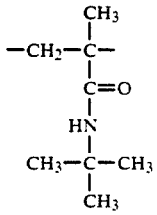

N-t-butylmethacrylamide (TBMA)

-continued

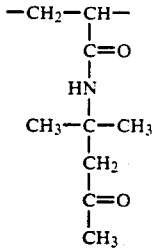

N-(1,1-dimethyl-3-oxobutyl)-acrylamide (DOA)

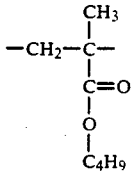

N-butylmethacrylate (NBM)

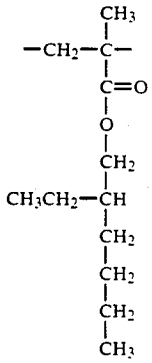

2-ethyl-hexylmethacrylate (2EHM)

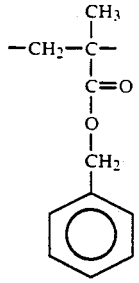

Benzylmethacrylate (BZM)

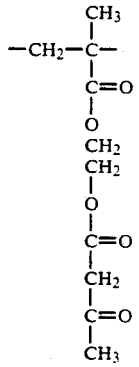

2-acetoacetoxyethylmethacrylate (crosslinker) (AAM)

Hydrophilic Monomers-Neutral

-continued

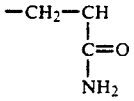

Acrylamide (A)

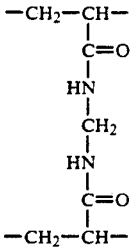

Methylene-bis-acrylamide (difunctional) (MBA)

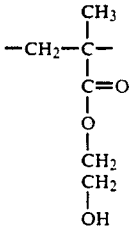

Hydroxyethylmethacrylate (HEM)

Hydrophilic Monomers-Cationic

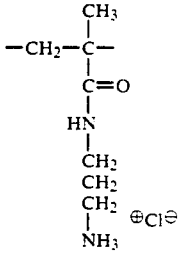

N-(3-aminopropyl)methacrylamide hydrochoride (APM)

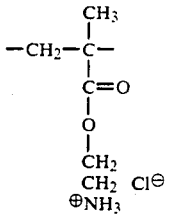

Aminoethylmethacrylate Hydrochloride (AEM)

Hydrophilic Monomers-Anionic

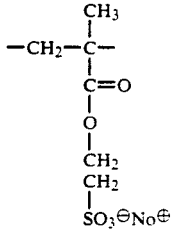

Sulfo-ethylmethacrylate. Sodium Salt (SEM)

-continued

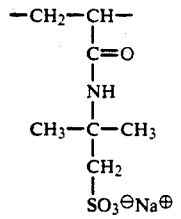

N-(2-Sulfo-1, 1-dimethyl-ethyl)acrylamide sodium salt (SSA)

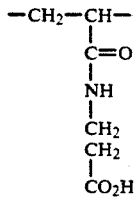

N-2-carboxyethylacrylamide (CEA)

e.g. 2,5-dihydroxy-4-(1-methylheptadecyl benzenesulfonic acid-monopotassium salt, are not added directly to the barrier layer but may be utilized in other layers. These surfactant compounds may diffuse and become associated with the polymer layer and affect the hydrophobicity of the polymer layer. All surfactants appear to increase the hydrophobic nature of the subject polymer layers, but surfactants or surfactant-like compounds of opposite charge to the utilized polymer are more effective at reducing permeability.

The TRG polymers described above are a particularly preferred class of polymers of this invention. Solutions of such polymers are advantageous for coating because they can either be heat thickened or chill thickened upon application to a film to form layers with sharp and distinct interfaces. The use and preparation of TRG polymers is more fully described in U.S. application Ser. No. 502,726.

In the practice of this invention there are at least a first and second silver halide emulsion layer, the first of which is in reactive association with a DIR compound. The barrier layer, also called the polymer layer, is

TABLE 1

MONOMER COMPOSITION OF POLYMERS OF THIS INVENTION

| Polymer Designation | Charge Type | Monomers | Thermo Reversible Gelling | Monomer Ratios | |
|---|---|---|---|---|---|
| D | Cationic | (IPA)(APM) | Yes | 90:10 | mole |
| E | Cationic | (IPA)(APM) | Yes | 92:8 | mole |
| F | Cationic | (IPA)(A)(APM) | Yes | 85:10:5 | mole |
| G | Cationic | (TBA)(APM) | Yes | 75:25 | mole |
| H | Cationic | (TBA)(APM) | Yes | 80:20 | mole |
| I | Cationic | (TBA)(APM) | Yes | 83:17 | mole |
| J | Cationic | (TBA)(APM) | Yes | 84:16 | mole |
| K | Cationic | (NBA)(APM) | Yes | 80:20 | mole |
| L | Cationic | (TBMA)(APM) | Yes | 80:20 | mole |
| M | Cationic | (TBA)(IPA)(APM) | Yes | 65:20:15 | mole |
| N | Cationic | (DOA)(APM) | Yes | 80:20 | mole |
| O | Cationic | (TBA)(DOA)(APM) | Yes | 60:20:20 | mole |
| P | Cationic | (IPA)(MBA)(APM) | Yes | 80:10:10 | wt % |
| Q | Cationic | (NBM)(AEM)(HEM) | No | 50:15:35 | wt % |
| Qa | Cationic | (NBM)(AEM)(HEM) | No | 50:30:20 | wt % |
| R | Cationic | (NBM)(AEM)(HEM) | No | 40:25:35 | wt % |
| S | Cationic | (NBM)(AEM)(HEM) | No | 26:22:52 | wt % |
| T | Cationic | (NMB)(AEM)(HEM) | No | 20:15:65 | wt % |
| U | Anionic | (TBA)(A)(SSA) | Yes | 75:20:5 | mole |
| V | Anionic | (NBM)(SEM)(AAM)(HEM) | No | 60:5:10:25 | wt % |
| Va | Anionic | (NBM)(SEM)(AAM)(HEM) | No | 70:2.5:10:17.5 | wt % |
| Vb | Anionic | (BZM)(SEM)(AAM)(HEM) | No | 50:2.5:10:37.5 | wt % |
| Vc | Anionic | (2EHM)(SEM)(AAM)(HEM) | No | 50:5:10:35 | wt % |
| Vd | Anionic | (NMB)(SEM)(AAM)(HEM) | No | 50:5:10:35 | wt % |
| Ve | Anionic | (BZM)(SEM)(AAM)(HEM) | No | 60:2.5:10:27.5 | wt % |
| W | Zwitterionic | (TBA)(CEA)(APM) | Yes | 76:8:16 | mole |
| X | Zwitterionic | (TBA)(A)(CEA)(APM) | Yes | 65:20:5:10 | mole |
| Y | Zwitterionic | (TBA)(A)(SSA)(APM) | Yes | 65:20:5:10 | mole |

The polymers can be prepared by synthetic procedures well known in the art. The polymers of this invention may be coated in the conventional manner. The amount of permeability of the barrier layer may be adjusted by adding gelatin or other water soluable polymers to the layer. Such water soluable polymers may comprise up to 50% of the barrier layer, but preferably no more than 25%. This method of adjusting permeability is particularly useful with polymers containing a high proportion of hydrophobic monomers and can alleviate the need to prepare different polymers for varying desired levels of permeability. The permeability of the layer may also be adjusted by varying the thickness of the polymer or polymer/gelatin layer. It has also been noted that surfactants or surfactant-like compounds, used with the polymer may affect the permeability. The surfactants or surfactant-like compounds, placed to allow the development inhibitor released by the DIR compound to react with the first silver halide emulsion layer and to retard the diffusion of the development inhibitor to the second silver halide emulsion layer. There may be many other types of layers in the photographic element, for example cushion layers and filter layers. The specific placement of the barrier layer is unimportant provided it retards the diffusion of the development inhibitor into a silver halide emulsion layers where the excessive interimage effects which would result are not desired. They may be any number of silver halide emulsion layers, more than one of which may be in reactive association with a DIR compound, contained in the photographic element. More than one barrier layer may be utilized to acheive the desired final photographic product. The barrier layer may also be placed in a manner to prevent the diffusion of development inhibitors into the processing solutions.

In the following discussion of suitable materials for use in the emulsions and elements of this invention, reference will be made to *Research Disclosure*, Dec. 1989, Item 308119, published by Kenneth Mason Publications, Ltd., Dudley Annex, 12a North Street, Emsworth, Hampshire P010 7DQ, ENGLAND, the disclosures of which are incorporated herein by the reference. This publication will be identified hereafter by the term "Research Disclosure".

The DIR compounds used in this invention are any of the compounds from which inhibitors have been released in the art. Typically, the compound contains a carrier group from which the inhibitor is released either directly or from an intervening timing group which is first released from the carrier group.

Carrier groups useful in DIR-compounds of this invention include various known groups from which the development inhibitor moiety can be released by a variety of mechanisms. Representative carrier groups are described, for example, in U.S. Pat. No. 3,227,550 and Canadian Patent No. 602,607 (release by chromogenic coupling); U.S. Pat. Nos. 3,443,939 and 3,443,940 (release by intramolecular ring closure); U.S. Pat. Nos. 3,628,952, 3,698,987, 3,725,062, 3,728,113, 3,844,785, 4,053,312, 4,055,428 and 4,076,529 (release after oxidation of carrier); U.S. Pat. No. 3,980,479, U.K. Patent Nos. 1,464,104 and 1,464,105 and U.S. Pat. No. 4,199,355 (release unless carrier is oxidized); and U.S. Pat. No.4,139,379 (release after reduction of carrier). Other examples of useful DIR compounds are described at Section VII of the *Research Disclosure*.

The timing group of the DIR-compounds of the invention can be any organic linking group which will serve to join the development inhibitor moiety to the carrier moiety and which, after its release from the carrier, will be cleaved from the development inhibitor fragment. Such timing groups are described in, e.g., in U.S. Pat. Nos. 4,248,962, Lau 4,409,323, and Sato, et al. Those compounds containing a timing group are development inhibitor anchimeric releasing (DIAR) compounds, and are included in the designation DIR-compounds.

The development inhibitor moiety can be present in the DIR-compound as a preformed species or it can be present in a blocked form or as a precursor. For example, a preformed development inhibitor may be attached to either the carrier of the timing group via a non-inhibiting function, or the development inhibiting function may be blocked by being the point of attachment or blocked by a hydrolyzable group.

When the DIR-compound is an inhibitor releasing developing agent of the type disclosed, for example, in U.S. Pat. Nos. 3,379,529, Porter, et al. and 4,684,694, Breuer, the development inhibitor group is imagewise released as a result of silver halide development by the developing agent, optionally in the presence of an auxiliary developing agent.

When the DIR-compound is a hydroquinone compound of the type described, for example, in European Patent Application No. 0,167,168, the development inhibitor is imagewise released by a redox reaction in the presence of an oxidized developing agent.

When the DIR-compound is a coupler, the development inhibitor group is imagewise released by a coupling reaction between the coupler and oxidized color developing agent. The carrier moiety can be any coupler moiety employed in conventional color photographic couplers which yield either colored or colorless products on reaction with oxidized color developing agents. Both types of coupler moieties are well known to those skilled in the art.

The silver halide emulsion empolyed in the elements of this invention can be either negative-working or positive-working. Examples of suitable emulsions and their preparation are described in Research Disclosure Sections I and II and the publication cited therein. Examples of suitable vehicles for the emulsion layers and other layers of elements of this invention are described in Research Disclosure Section IX and the publicaitons cited therein.

The photographic elements of this invention or individual layers thereof can contain, for example, brighteners (see Research Disclosure Section V), antifoggants and stabilizers (See Research Disclosure Section VI), antistain agents and image dye stabilizers (See Research Disclosure Section VII, paragraphs I and J), light absorbing and scattering materials (See Research Disclosure Section VIII), hardeners (See Research Disclosure Section IX), plasticizers and lubricants (See Research Disclosure Section XII) antistatic agents (See Research Disclosure Section XIII), matting agents (See Research Disclosure Section XVI) and development modifiers (See Research Disclosure Section XXI).

The photographic elements can be coated on a variety of supports such as described in Research Disclosure Section XVII and the references described therein.

Photographic elements can be exposed to actinic radiation, typically in the visible region of the spectrum, to form a latent image as described in Research Disclosure Section XVIII and then processed to form a visible dye image as described in Research Disclosure Section XIX. Processing to form a visible dye image includes the step of contacting the element with a color developing agent to reduce developable silver halide and oxidizing the color developing agent. Oxidized color developing agent in turn reacts with the coupler to yield a dye.

With negative working silver halide, the processing step described above gives a negative image. To obtain a positive (or reversal) image, this step can be preceded by development with a non-chromogenic developing agent to develop exposed silver halide, but not form dye, and then uniformly fogging the element to render unexposed silver halide developable. Alternatively, a direct positive emulsion can be employed to obtain a positive image.

The effectiveness of the barrier layers of the present invention is demonstrated by measuring changes in contrast of the causer and receiver layers as a function of the interlayer formulation. A causer layer is a silver halide emulsion layer which contains a DIR compound and a receiver layer is silver halide emulsion layer which is affected by a development inhibitor. It follows that if the barrier layer is relatively impermeable to the released development inhibitor species, thereby reducing its rate of interlayer diffusion, the receiver layer will see a decrease and the causer layer may see an increase in the effective concentration of the development inhibiting species. The photographic result of these changes will be shown as an increase in the contrast of the receiving layer, and in some instances, a decrease in the contrast of the causer layer. The change seen in the causer layer will be partially dependent upon its location within the photographic element.

A further consequence of the increased concentration of inhibitor species in the causer layer, effected by the polymer interlayers of this invention will be in most cases, enhanced sharpness or increased accutance of that layer. In contrast, it follows that polymer layers that reduce inhibitor or inhibitor precursor diffusion by absorbing or scavenging those species, will cause a reduction in effective concentration of those species in both the receiver and causer layers. The photographic result will be an increased contrast in both the causer and receiver, which in many cases results in the penalty of reduced accutance in the causer layer. This can be particularly deleterious to cyan causer layers that depend heavily on DIR and DIAR accutance enhancement effects for acceptable sharpness levels. The polymers of this invention increase receiver layer contrast, a desired effect, without the penalty of reduced causer accutance, and in some cases, with a corresponding causer accutance increase.

The following examples further illustrate certain embodiments and are not intended to limit the scope of this invention.

PREPARATIVE EXAMPLE 1

Preparation of Polymer H (TBA)(AMP) 80:20 mole.

This procedure was also used to make the TRG polymers, D thru O, U, and W thru Y.

t-Butylacrylamide (101.6 g, 0.80 moles) and 3-aminopropylmethacrylamide hydrochloride (35.6 g, 0.20 moles) were combined at ambient temperatures with methanol (350 ml) and water (350 ml). The mixture was purged 15 minutes with nitrogen and was then heated to 60° C. The starting materials dissolved within 10 min. at which time 2,2-azobis(2-methylpropionitrile) (AIBN) (1.6 g, 0.01 moles in 60 ml methanol) was added in one portion. The solution became slightly hazy over an 18-hour period. The solution was diluted with 700 ml water and was concentrated in an open beaker with a nitrogen inlet at 60° C. until about 300 ml had been removed thereby removing the menthanol and obtaining an aqueous polymer solution suitable for use in photographic coatings without further purification.

wt 1255 g: 10.23% solids

Anal. THEORY: C, 61.15; H, 9.82 N, 12.22; Cl, 5.15; FOUND: C, 59.93; H, 9.71; N, 11.95; Cl, 5.19.

iv: (0.25% in 0.1N LiCl/methanol) 1.06 wt % APM: 25.4, 26.3 (methanol, titrated with hexadecyl trimethylammonium hydroxide (HDTMAH))

wt % HCl: 0.74, 255 w % MeOH: 9.1

PREPARATIVE EXAMPLE 2

Preparation of Polymer V (NBM)(SEM)(AAM)-(HEM) 60:5:10:25 wt.

This procedure also used to make polymers Va thru Ve.

A mixture of n-butyl methacrylate (48.0 g, 0.34 mole), sodium 2-methacryloyloxyethyl-1-sulfonate (4.0 g, 0.019 mole), 2-acetoacetoxyethyl methacrylate 8.0 g, 0.037 mole, 2-hydroxyethyl methacrylate (20.0 g, 0.154 mole) and 2,2'-azobis(2-methylpropionitrile) (600 mg) in dimethyl sulfoxide (400 ml) was maintained under a nitrogen atmosphere at 60° C. in a constant temperature water bath for 20 hours. Ethanol (600 ml) and distilled water (1.2 liter) were added to the polymer solution at 60° C over a period of 15 min. After stirring at 60° C. for 1 hour, the solution was diafiltered (10 passes in distilled water) thereby resulting in a viscous solution consisting of 11.4% solids; yield 80%. The polymer had an inherent viscosity of 0.32 in 0.1 N-tertiary butylammonium bromide/ethanol.

PREPARATIVE EXAMPLE 3

Preparation of Polymer Oa (NBM)(AEM)(HEM) 50:31:20 wt %.

This procedure was also used to make polymers Q thru T.

A mixture of n-butyl methacrylate(40.0 g, 0.282 mole), 2-aminoethyl methacrylate hydrochloride (24 g, 0.145 mole), 2-hydroxyethyl methacrylate (16.0 g, 0.170 mole), and 2,2'-azobis(2-methylpropionitrile) (200 mg) in dimethyl sulfoxide (500 ml) was maintained under a nitrogen atmosphere and heated at 60° C. in a constant temperature water bath for 20 hrs. The polymer was then precipitated from solution by adding to ethyl acetate (8 l). The solvent was decanted and the precipitate quickly dissolved in water (1300 ml) and methanol (400 ml). The solution was dialyzed in distilled water for 24 hrs. Water was removed using a rotary evaporator under vacuum and the resulting viscous solution contained 11.3 percent solids. The polymer had an inherent viscosity of 0.50 in water.

The couplers shown below were used to prepare the photographic elements of the following examples, Couplers
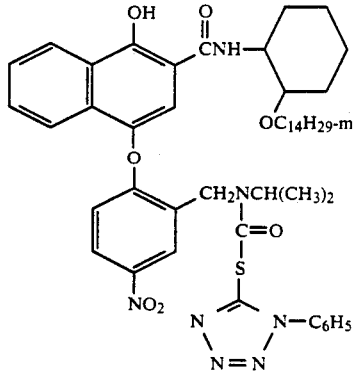
DIAR I Coupler
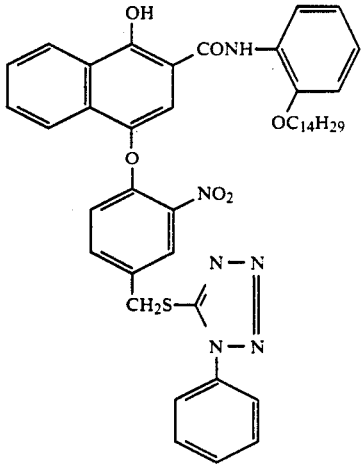
DIAR II COUPLER
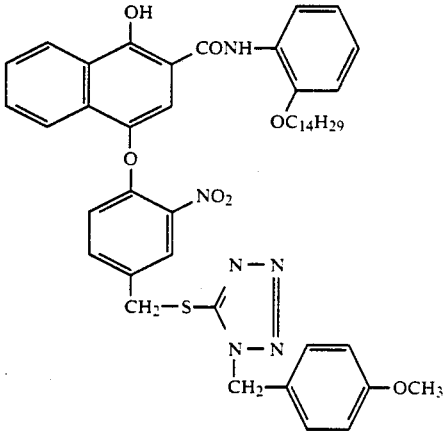
DIAR III Coupler
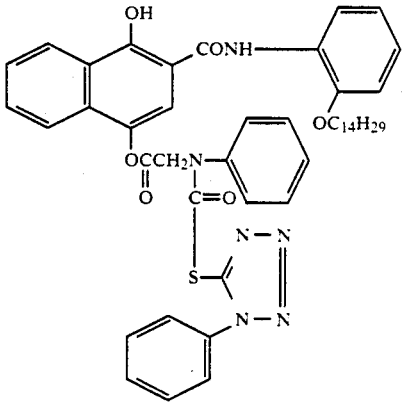
DIAR IV Coupler
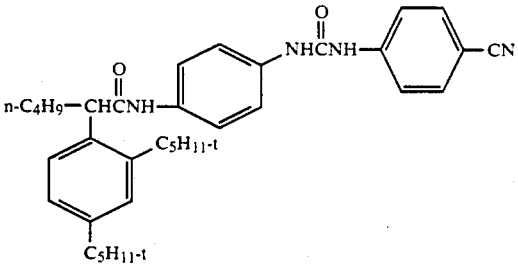
Cyan A Color Coupler
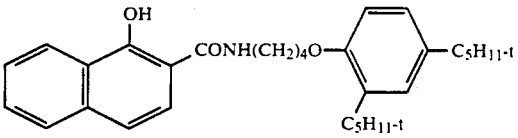
Cyan B Color Coupler
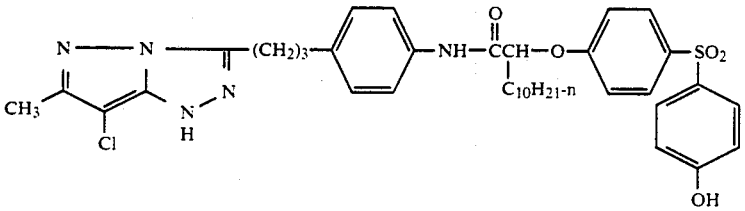
Magenta Color Coupler -continued Couplers

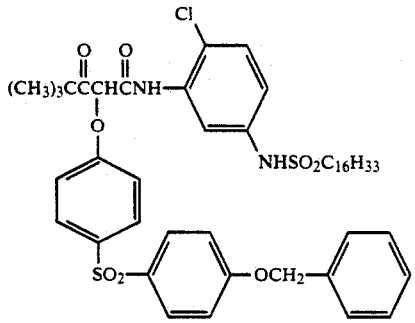

Yellow Color Coupler

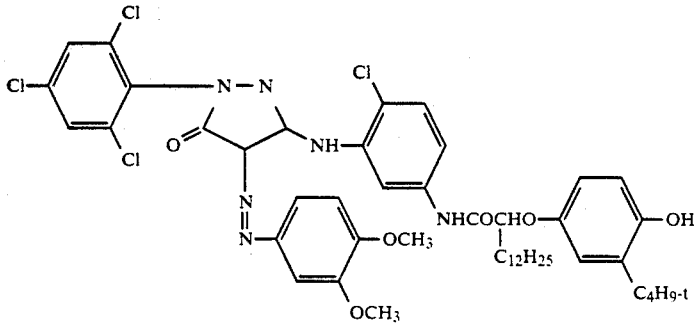

Magenta Forming Yellow Masking Coupler

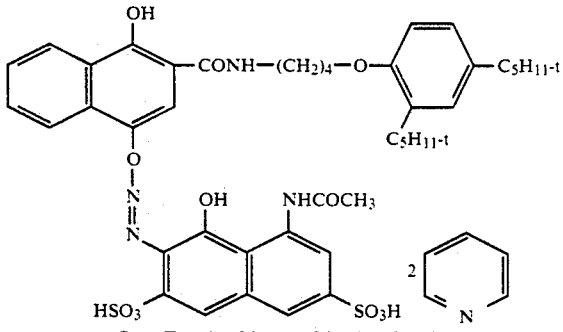

Cyan Forming Magenta Masking Coupler

PREPARATIVE EXAMPLE 4

Preparation of Photographic Elements

A series of multilayer color photographic elements having a receiver layer over a causer layer format were prepared:

| |
|---|
| Overcoat Layer |
| Receiver Layer |
| Gelatin Interlayer or Barrier Layer |
| Causer Layer |
| Support |

The photographic elements comprised a transparent photographic support with a grey silver antihalation layer having coated thereon in the layer order recited:

1) Causer Layer a. A blend of two red sensitized silver bromoiodide emulsions comprising 1.13 and 0.48 g/m$^2$ Ag, respectively b. 0.721 g/m$^2$ of cyan dye forming coupler A (FIG. 3) in a conventional coupler solvent dispersion.

c. 0.061 g/m$^2$ of cyan-forming magenta masking coupler (see FIG. 3) as a Fischer-type dispersion.

d. 2.4 g/mole Ag of 2,5-dihydroxy-4-(1-methylheptadecyl)Benzenesulfonic acid-monopotassium salt, (referred to herein as OXI) a scavenger for oxidized developer.

e. 1.75 g/mole Ag of an anti-foggant, 5-methyl-s-triazole-(2-3-a)-pyrimidine-7-ol, sodium salt.

f. A DIAR in a conventional coupler solvent dispersion, whose type and quantity will be indicated in the specific examples cited.

g. 2.47 g/m$^2$ gelatin, h. Coating aids were a sodium salt of alkylaryl polyether sulfonate (Triton® X-200)(Rohm & Hass Company, Philadelphia, Pa.) and a non-ionic nonylenoxylpolyglycidol (Olin surfactant 10G)(Olin Corporation, Stanford, Conn.). They were coated at 0.05/0.025 wt % respectively in the coating melt, unless otherwise specified.

2) Interlayer a. Either 0.86 g/m$^2$ gelatin or between 0.43 and 1.08 g/m$^2$ of the polymers of this invention, to be indicated in the specific examples cited. The polymer interlayers of this invention may also contain mixtures with gelatin, up to 50% of the total. For polymers A-C, the interlayer consisted of 2.42 g/m$^2$ gelatin (type 5) and 0.81 g/m$^2$ polymer as specified in U.S. Pat. No. 3,985,245.

b. Coating aids were mixtures of either a non-ionic fluoroalkyl-polyethyleneoxide (Zonyl FSN)(Tradename, DuPont Company, Chemicals and Pigments Department, Wilmington, Del.) or a non-ionic alkoxylated alcohol (Sandoxylate)(-Tradename, Sandoz Chemicals Corporation, Charlotte, N.C.) with Olin 10G, as indicated in the specific examples.

3) Receiver Layer a. A blend of two green-sensitized silver bromoiodide emulsions, 1.34 g/m$^2$ and 0.90 g/m$^2$ respectively.
b. 0.67 g/m2 magenta image coupler (see FIG. 3) in a conventional coupler solvent dispersion.
c. 0.06 g/m2 magenta-forming yellow masking coupler in a conventional coupler solvent dispersion.
d. 2.4 g/mole Ag 2,5-dihydroxy-4-(1methylheptadecyl)Benzenesulfonic acid-monopotassium salt (OXI).
e. 1.61 g/m$^2$ gelatin total
f. Coating aids were as in the causer layer, and will be indicated in the specific examples.

4) Overcoat Layer a. 1.61 g/m2 gelatin.
b. Bis vinyl sulfonyl methane, at 1.75 wt % relative to total gelatin content in all layers.

The coated elements were exposed on an Eastman 1B sensitometer whereby three separate 11 step (0.3 inc) graduated density charts were sequentially exposed on three separate areas of a single 305×35 mm strip with the three charts representing a red only, green only, and red plus green exposure, respectively. A typical set of exposure conditions were as follows: 1/25 sec with a WR29+ 1.1ND filter pack for red only, 1/25 sec with WR99+ 0.3ND filter pack for green only, and the red and green exposures sequentially placed over the third chart for the combined red plus green exposure.

The strips were processed at 100° F. using the color negative process C-41 as described in the British Journal of Photography Annal, pg. 191 (1988) hereby incorporated by reference. The strips were routinely inspected for residual silver. All the examples contained no visual sign of retained silver unless noted otherwise, a result that was confirmed by X-ray silver analysis of selected samples.

The developed density scales were plotted in status M densities on a D log E plot, and the slopes, or contrasts (Gamma) were measured. The ability of the polymeric interlayer to control diffusion of the released development inhibitor or their precursors between silver halide layers was monitored by changes in contrast of the causer and receiver layer relative to the gelatin only interlayer. Imagewise changes in contrast caused by one layer upon another are often referred to as "interlayer interimage effects", or IIE; a quantitative measure of red onto green (R→G) IIE used in these examples was the receiver contrast ratio:

Green contrast (G) (Green only)/Green contrast (R+G) (Red+Green)

Values of this ratio for the gelatin interlayer controls exhibiting full IIE were typically 2 to 3.5, as a result of the migration of inhibitor from the red causer layer to the green receiver layer when both layers were exposed. Values of the ratio were reduced when polymeric interlayers were effective in reducing inhibitor interlayer diffusion, as the contrast of the receiver layer (R+G) was increased, and the extreme case of no IIE resulted in a ratio of about 1. Another photographic indication of inhibitor diffusion control was the red causer contrast, which usually was reduced by the polymeric layers.

Intralayer inhibitor effects were also indicated by sharpness as measured by CMT accutance (60% modulation, Magnification Factor=11.7). It follows that increases in effective concentration of the inhibitors in the red causer layer are usually indicated by an increase in CMT accutance.

Polymers A-C, which are described in the art as being absorbers or scavengers for development inhibitors or their precursors, were synthesized for comparative purposes, and the structures of their repeat units are shown below.

Absorbing Polymers (A-C)

A

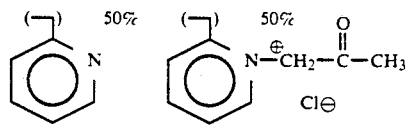

U.S. Pat. No. 3,984,245

B

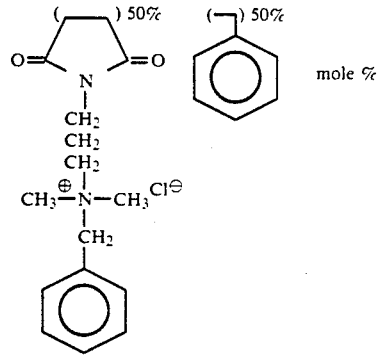

U.S. Pat. No. 3,984,245

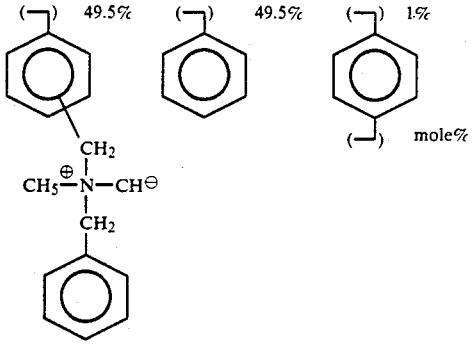

U.S. Pat No. 4,055,429

COMPARATIVE EXAMPLE 5

ELEMENTS 1-11

These coatings contained the cyan DIAR I in the causer layer at 0.097 g/m$^2$. The specific coating aids used and the interlayer compositions of the coatings are listed in the data Table 2. Table 2 lists the IIE values and CMT accutance of the red causer for each of the polymeric interlayer elements relative to an appropriate gelatin interlayer control. Control coatings were coated in the same coating set as their polymeric counterparts whenever possible, and were always co-processed with their respective polymeric elements.

All the polymers used in elements 1-11 reduced R→IIE relative to a gelatin layer control. Elements 1-3, which contain absorbing polymers A-C also cause reductions in causer CMT accutance, whereas elements 4-11 containing polymers of this invention all show equivalent or increased values of accutance relative to their respective controls (experimental error 0.5 CMT). These examples demonstrate the unique ability of the non-absorbing polymers to reduce excessive IIE for better color reproduction without paying the penalty of reduced causer accutance.

Comparison of the results for elements 4 and 5 demonstrates a method of modulating IIE by varying the thickness of the interlayer, whereby thicker layers give greater diffusion control, and less IIE. This was a general result, and allows one to fit the desired amount of IIE to suit a particular system.

ILLUSTRATIVE EXAMPLE 6

ELEMENTS 12-27

These elements contain DIAR II at between 0.086 and 0.108 g/m$^2$, with coating aids and interlayer compositions indicated in table 3. The data in table 3, IIE and causer accutance, further demonstrate the utility of these non-absorbing polymers for reducing IIE while maintaining or increasing causer accutance. Comparison of elements 14 and 15 (polymers G and H) demonstrate another way of modulating the IIE reduction by varying the hydrophobic/hydrophilic balance of the polymer. Polymer H contains more of the hydrophobic monomer TBA, than polymer G, and consequently reduces interlayer diffusion more effectively. Further increases in the TBA content of this polymer, as in element 21 (polymer J), reduces permeability further, to the extent that gelatin must be included in the layer to allow for effective diffusion of fixer. Coated alone at the indicated thickness Polymer J would produce a processed film with retained silver.

ELEMENTS 28-33

These elements contain DIAR III at 0.108 g/m$^2$, and the data are listed in Table 4.

ELEMENTS 34 and 35

These elements contain DIAR IV at 0.12 g/m$^2$, and the data are listed in Table 5.

ELEMENTS 36-38

The data for these elements are listed in table 6, and they demonstrate the preferred method of modulating the IIE with the polymeric layers of this invention, namely, by mixing gelatin with the polymers. In these elements, the polymer J[(TBA)(APM)84:16] by itself, would be too impermeable, but with the addition of small and specific amounts of gelatin, a given level of IIE reduction can be attained, while allowing for full diffusion of processing chemicals. Thus, only one polymer need be provided for a variety of IIE level requirements for various color negative products.

ELEMENTS 39-45

The data for these elements are found in Table 7, and they indicate the effects that surfactants commonly used in photographic coatings, and placed in layers other than the barrier layer, can have in modulating the diffusion of inhibitors through the polymer layers, and hence, the effects on IIE control. Elements 39-42 demonstrate that when polymer E is present in the interlayer, a less permeable barrier layer results when the surfactant Fluorotenside FT-248 (Mobay Chemical Company, Pittsburgh, Pa.), (the tetra ethylammonium salt of perfluorooctyl sulfonic acid) is used as a coating aid in the green and overcoat layers in place of the anionic surfactant, Triton ® X-200. Thus, specific combinations of polymer layers and coating surfactants placed in other layers may be advantageous. Elements 43-45 show that with polymer H in the interlayer, replacing the anionic surfactant Triton ® X-200 in all the imaging and overcoat layers with the non-ionic surfactant Olin 10G, a more permeable (less effective) polymer layer results as indicated by higher IIE values. Furthermore, removal of the oxidized developer scavenger OXI (Element 45), which has a surfactant-like structure, further increases the permeability of the polymer layer.

In general, surfactants of the opposite charge type from the polymer are more effective than non-ionic surfactants, or surfactants of the same charge type. In certain cases, these effects may be advantageous when they allow for a very effective polymer layer to be coated in a more hydrophillic form than would be possible otherwise. It is presumed that the enhancing surfactants diffuse into the polymer interlayers during subsequent coating operations and increase the hydroprobic content of the layer.

TABLE 2

Receiver Contrast and CMT Accutance of Causer Coatings Containg DIAR I.[1]

| Element No. | Interlayer Composition[3] in g/m$^2$ | Receiver Contrast[2] G[4] | Receiver Contrast[2] Gr + g[5] | R→G IIE Gr + g | Red (Causer) CMT |
|---|---|---|---|---|---|
| Control | 3.23 Gel V | 2.69 | 1.47 | 1.83 | 86.8 |
| 1 | 0.81 Polymer A + 2.42 gel V | 2.51 | 2.07 | 1.21 | 85.2 |
| 2 | 0.81 Polymer B + 2.42 gel V | 2.46 | 2.09 | 1.18 | 84.0 |
| 3 | 0.81 Polymer C + 2.42 gel V | 2.29 | 2.28 | 1.00 | 83.6 |
| Control | 0.86 gel IV | 2.20 | 0.85 | 2.60 | 90.4 |
| 4 | 0.86 Polymer D | 2.08 | 1.58 | 1.32 | 93.6 |
| 5 | 0.54 Polymer D | 2.10 | 1.30 | 1.62 | 91.5 |
| Control | 0.86 gel IV | 2.72 | 1.25 | 2.18 | 88.6 |
| 6 | 0.86 Polymer G | 2.60 | 1.70 | 1.53 | 89.4 |
| Control | 0.86 gel IV | 2.82 | 1.46 | 1.93 | 88.5 |
| 7 | 0.78 Polymer V + 0.08 gel IV | 2.79 | 2.00 | 1.40 | 90.6 |
| Control | 0.86 gel IV | 2.66 | 1.60 | 1.66 | 88.7 |

TABLE 2-continued

Receiver Contrast and CMT Accutance of Causer Coatings Containg DIAR I.[1]

| Element No. | Interlayer Composition[3] in g/m² | Receiver Contrast[2] G[4] | Receiver Contrast[2] Gr + g[5] | R→G IIE Gr + g | Red (Causer) CMT |
|---|---|---|---|---|---|
| 8 | 0.65 Polymer Q + 20 gel V | 2.68 | 1.84 | 1.46 | 88.7 |
| Control | 0.86 gel IV | 2.56 | 1.04 | 2.46 | 90.0 |
| 9 | 0.86 Polymer R | 2.56 | 1.61 | 1.59 | 89.7 |
| Control | 0.86 gel IV | 2.56 | 1.06 | 2.42 | 90.0 |
| 10 | 0.86 Polymer T | 2.64 | 1.70 | 1.55 | 89.5 |
| Control | 0.86 gel IV | 2.72 | 1.25 | 2.18 | 88.6 |
| 11 | 0.86 Polymer N | 2.77 | 1.84 | 1.51 | 89.6 |

[1]DIAR @ 0.97 g/m² in Cyan Layer
[2]Coating Aids: (Green receiver lyaer & overcoat) Examples 1, 2, 3, 6, 11 used Triton ® X-200/Olin 10G @ .05/.025 wt % active in coating solution. Examples 4, 5, 7, 8, 9, 10 used FT-248 @ .09 wt % active in coating solution.
[3]Coating Aids: 0.1 wt % Sandoxylate SX-418 + 0.02 wt % Zonyl FSN in coating solution Examples 1, 2, 3, 6, 11. 0.1% wt % Zonyl FSN + 0.06 wt % Olin 10G in coating solution Examples 4, 5, 7, 8, 9, 10.
[4]Contrast for Green-only exposure
[5]Contrast for Red + Green exposure

TABLE 3

Receiver Contrast and Causer Accutance of Coatings Containg DIAR II.[6]

| Element | Interlayer Composition[8] in g/m² | Receiver Contrast[7] G | Receiver Contrast[7] Gr + g | R→G IIE | Red (Causer) CMT |
|---|---|---|---|---|---|
| Control | 0.86 gel IV | 2.19 | 0.87 | 2.52 | 90.5 |
| 12 | 0.65 Polymer D | 2.18 | 1.32 | 1.65 | 93.8 |
| 13 | 0.78 Polymer V + 0.08 gel IV | 2.25 | 0.99 | 2.27 | 91.8 |
| Control | 0.86 gel IV | 2.62 | 0.87 | 3.01 | 91.9 |
| 14 | 0.86 Polymer G | 2.75 | 1.25 | 2.20 | 93.3 |
| 15 | 0.86 Polymer H | 2.64 | 2.05 | 1.29 | 95.5 |
| 16 | 0.75 Polymer U + 0.11 gel V | 2.37 | 1.06 | 2.23 | 92.7 |
| Control | 0.86 gel IV | 2.05 | 0.90 | 2.27 | 90.2 |
| 17 | 0.65 Polymer E | 2.00 | 1.05 | 1.90 | 92.7 |
| 18 | 0.65 Polymer F | 2.14 | 1.49 | 1.44 | 92.2 |
| 19 | 0.61 Polymer P + 0.032 gel V | 2.12 | 1.37 | 1.55 | 91.1 |
| 20 | 0.86 Polymer S | 2.20 | 1.11 | 1.98 | 92.0 |
| Control | 0.86 gel IV | 2.33 | 0.71 | 3.28 | 92.0 |
| 21 | 0.78 Polymer J + 0.08 gel V | 2.46 | 1.27 | 1.94 | 93.7 |
| 22 | 0.78 Polymer K + 0.08 gel V | 2.40 | 1.33 | 1.80 | 92.1 |
| 23 | 0.78 Polymer L + 0.08 gel V | 2.42 | 2.17 | 1.11 | 95.7 |
| Control | 0.86 gel IV | 2.58 | 0.99 | 2.61 | 91.7 |
| 24 | 0.78 Polymer M ;30 0.08 gel V | 2.55 | 1.60 | 1.59 | 94.4 |
| Control | 0.86 gel IV | 2.59 | 1.01 | 2.56 | 90.5 |
| 25 | 0.78 Polymer O + 0.08 gel V | 2.51 | 1.45 | 1.73 | 93.6 |
| Control | 0.86 gel IV | 2.62 | 0.87 | 3.01 | 91.9 |
| 26 | 0.82 Polymer X + 0.04 gel V | 2.33 | 1.85 | 1.26 | 92.9 |
| 27 | 0.75 Polymer Y + 0.11 gel V | 2.41 | 1.17 | 2.06 | 92.6 |

[6]DIAR II Examples 12-15, 20-27 @ 0.11 g/m²; Examples 16-19, @ 0.086 g/m²
[7]Coating Aids for Green + Overcoat: Examples 12, 13, 16-19; FT-248 @ 0.1 wt % Active in coating solution. Examples 14, 15, 20-27; Triton ® X-200/Olin 10G 0.05/.025 wt % Active in coating solution
[8]Coating Aids: Examples 12, 13, 0.1 wt % Zonyl FSN + 0.06 wt % Olin 10G (Active) in coating solution (Interlayer) Examples 14-27, 0.1 wt % Sandoxylate + 0.02 wt % Zonyl FSN (Active) in coating solution

TABLE 4

Receiver Contrast and Causer Accutance of Coatings Containg DIAR III.[9]

| Element No. | Interlayer Composition[11] in g/m² | Receiver Contrast[10] G | Receiver Contrast[10] Gr + g | R→G IIE | Red (Causer) CMT |
|---|---|---|---|---|---|
| Control | 0.86 gel IV | 2.82 | 1.14 | 2.47 | 88.6 |
| 28 | 0.43 Polymer H | 2.87 | 2.52 | 1.14 | 92.0 |
| 29 | 0.86 Polymer N | 2.84 | 1.75 | 1.62 | 89.2 |
| Control | 0.86 gel IV | 2.75 | 1.54 | 1.79 | 89 4 |
| 30 | 0.78 Polymer I + 0.08 gel V | 2.60 | 2.17 | 1.20 | 91.8 |
| 31 | 0.82 Polymer W + 0.04 gel V | 2.65 | 1.99 | 1.33 | 89.1 |
| 32 | Polymer K | 2.62 | 2.29 | 1.14 | 90.7 |
| 33 | Polymer U + 0.11 gel V | 2.55 | 1.78 | 1.43 | 89.3 |

[9]DIAR III Examples @ 0.11 g/m²
[10]Coating Aids for Green + Overcoat: Triton ® X-200/Olin 10G @ 0.05/.025 wt % active in coating solution.
[11]Coating Aids for Interlayer: 0.1 wt % Sandoxylate + 0.02 wt % Zonyl FSN active in coating solution.

TABLE 5

Receiver Contrast and Causer Accutance of Coatings Containg DIAR IV.[12]

| Element No. | Interlayer Composition[14] in g/m² | Receiver Contrast[13] G | Receiver Contrast[13] Gr + g | R→G IIE | Red (Causer) CMT |
|---|---|---|---|---|---|
| Control | 0.86 gel IV | 2.19 | 0.91 | 2.52 | 90.7 |
| 34 | 0.65 Polymer D | 2.24 | 1.30 | 1.72 | 91.8 |

TABLE 5-continued

| Element No. | Interlayer Composition[14] in g/m² | Receiver Contrast[13] G | Gr + g | R→G IIE | Red (Causer) CMT |
|---|---|---|---|---|---|
| 35 | 0.78 Polymer V + 0.08 gel IV | 2.02 | 1.16 | 1.74 | 92.9 |

Receiver Contrast and Causer Accutance of Coatings Containg DIAR IV.[12]

[12]DIAR IV @ 12.2 g/m²
[13]Coating Aids for Green + Overcoat: FT-248 @ 0.1 wt % Acitve in coating solutions.
[14]Coating Aids for Interlayer: 0.1 wt % Zonyl FSN + 0.06 wt % Olin 10G (active) in coatings solutions.

TABLE 6

Effect of Gelatin Levels in Interlayers Contaig Polymers DIAR II.[15]

| Element No. | Interlayer Composition[17] in g/m² | Receiver Contrast[16] G | Gr + g | R→G IIE | Red (Causer) CMT |
|---|---|---|---|---|---|
| Control | 0.86 gel IV | 2.33 | 0.71 | 3.28 | 92.0 |
| 36 | 0.82 Polymer J + 0.04 gel V | 2.49 | 1.87 | 1.33 | 95.5 |
| 21 | 0.78 Polymer J + 0.08 gel V | 2.46 | 1.27 | 1.94 | 93.7 |
| 37 | 0.73 Polymer J + 0.13 gel V | 2.53 | 1.21 | 2.09 | 93.2 |
| 38 | 0.69 Polymer J + 0.17 gel V | 2.54 | 1.20 | 2.12 | 92.6 |

[15]DIAR II = @ 0.11 g/m²
[16]Coating Aids for Green + Overcoat: Triton ®X-200/10G @ 0.05/0.025 wt % (active) in coating solutions.
[17]Coating Aids for Interlayer: 0.1 wt % Sandoxylate + 0.02 wt % Zonyl FSN (Active) in coating solutions.

TABLE 7

Effects of Surfactant Variations in Imaging Layers.

| Element No. | Interlayer Composition[18] g/m² | Surfactant Variations[19] | DIAR (g/m²) | Receiver Contrast G | Gr + g | R→G IIE | Red (Causer) CMT |
|---|---|---|---|---|---|---|---|
| Control | 0.86 gel IV | TX-200/10 G | I(0.097) | 2.43 | 1.07 | 2.27 | NA* |
| 39 | 0.86 Polymer E | TX-200/10G | I(0.097) | 2.05 | 1.09 | 1.92 | NA* |
| 40 | 0.86 Polymer E | FT-248 | I(0.097) | 2.10 | 1.43 | 1.46 | NA* |
| Control | 0.86 Gel IV | TX-200/10G | II(0.11) | 2.27 | 0.65 | 3.44 | NA* |
| 41 | 0.65 Polymer E | TX-200/10G | II(0.11) | 1.96 | 0.78 | 2.51 | NA* |
| 42 | 0.65 Polymer E | FT-248 | II(0.11) | 1.99 | 1.06 | 1.88 | NA* |
| Control | 0.86 Gel IV | TX-200/10G/OXI | II(0.11) | | | 3.42 | 90.8 |
| 43 | 0.86 Polymer H | YES YES YES | II(0.11) | | | 1.20 | 95.0 |
| 44 | 0.86 Polymer H | NO YES YES | II(0.11) | | | 1.83 | 92.2 |
| 45 | 0.86 Polymer H | NO YES NO | II(0.11) | | | 2.23 | 90.6 |

* = Not Available
[18]Coating Aids for Interlayer. 0.1 wt % Sandoxylate + 0.02 wt % Zonyl FSN in coating solution.
[19]Examples 39–42. surfactant variations in receiver and overcoat layer Triton ®X-200/10 g at 0.05/0.025 wt % in coating solution: FT-248 @ 0.09 wt % in coating solution: causer layer contained Triton ® X-200/10 g @ .05/.025 wt % in coating solution.
Examples 43–45. surfactant variations occurred in causer. receiver and overcoat. at levels indicated in prior examples. When Triton ® X-200 was deleted as a coating aid. it was replaced with an equal amount of Olin 10G. a non-ionic surfactant. When OXI was omitted it was removed from both the causer and receiver layers.

PREPARATIVE EXAMPLE 7

A series of multilayer color photographic elements having a causer layer over receiver layer format were prepared:

Overcoat Layer
Causer Layer
Gelatin Interlayer or Barrier Layer
Receiver Layer
/ / Support / / / /

The photographic elements comprised a transparent photographic support with a grey silver antihalation layer having coated thereon in the layer order recited:

Receiver Layer 1.
a.) A red-sensitized silver bromoiodide emulsion layer comprising 1.59 g/m² Ag,
b.) 1.29 g/m² of yellow dye forming Coupler (see FIG. 3) in a conventional coupler solvent dispersion,
c.) 2.42 g/m² of gelatin.

Interlayer

2. Either 0.54 g/m² of gelatin or 0.54 g/m² of poly(n-butyl methacrylate-co-2-aminoethyl methacrylate hydrochloride-so-2-hydroxyethyl methacrylate), weight ratio 50:30:20. (Polymer Qa)

Causer Layer 3.
a.) A green-sensitized silver bromoiodide emulsion, 1.59 g Ag/m²,
b.) 0.75 g/m² cyan dye-forming Coupler B in a conventional coupler solvent dispersion,
c.) 2.42 g/m² of gelatin, with and without 0.08 g/m² of cyan dye-forming DIAR Coupler I.

Overcoat Layer 4. 0.86 g/m² of gelatin.

The resulting photographic elements were exposed for 1 second on an Eastman 1B sensitometer through a WR-12 filter and a graduated density test chart, and them processed in the C-41 color process (2¼ minutes development at 38° C.).

ILLUSTRATIVE EXAMPLE 8

The ability of the polymeric interlayer Qa to control diffusion of the released development inhibitor between silver halide layers was monitored by changes in contrast of the causer and receiver layers. The photographic results, which are shown in Table 8, clearly illustrate that a polymeric barrier of the present invention is much more effective at reducing diffusion of the released development inhibitor between silver halide layers than is a common gelatin layer.

ILLUSTRATIVE EXAMPLE 9

A series of multilayer color photographic elements having a causer layer over receiver layer format were prepared as in example 7, except that the Polymeric layer was comprised of 0.54 g/m$^2$ Polymer V.

The resulting photographic elements were exposed for ½ second on an Eastman 1B sensitometer through a WR-12 filter and a graduated density test chart, and then processed in the C-41 color process (2¾ minutes development at 38° C.). The photographic results are shown in Table 9.

ILLUSTRATIVE EXAMPLE 10

A series of multilayer photographic elements were coated as described in Example 7. The polymers utilized as barrier layers were prepared utilizing different hydrophobic monomers in place of butyl methacrylate. Weight ratios variations of the monomers utilized were also prepared and coated. The coated elements were then evaluated as in Example 9. The results of the photographic evaluation are shown in Table 9.

The photographic results, which are shown in Table 9, clearly illustrate that the polymeric barrier of the present invention is much more effective at reducing diffusion of the released development inhibitor between silver halide layers than is a common gelatin layer.

TABLE 8

| Interlayer Feature | Causer Layer Feature | Control of IIE with Polymer Barrier Layer (Causer Layer above Receiver Layer) Contrast (Y) Causer | Contrast (Y) Receiver | % Contrast Loss* Causer/Receiver | % Aim Contrast of Receiver** |
|---|---|---|---|---|---|
| Gelatin | No Inhibitor | 1.80 | 0.90 | | |
| | | | | 72/77 | 22 |
| Gelatin | +Inhibitor (DIAR) | 0.50 | 0.20 | | |
| Polymer Qa | No Inhibitor | 1.80 | 0.90 | | |
| | | | | 55/17 | 91 |
| Polymer Qa | +Inhibitor (DIAR) | 0.80 | 0.74 | | |

$$*\%\ \text{Contract Loss} = \frac{\gamma\ \text{Receiver}\ (+\text{Inhibitor}) - \gamma + \text{Inhibitor}}{\gamma\ \text{Receiver (No Inhibitor)}} \times 100$$

$$**\%\ \text{Aim Contrast of Receiver} = \frac{\gamma\ \text{Receiver}\ (+\text{Inhibitor})}{\gamma\ \text{Receiver (No Inhibitor)}} \times 100$$

TABLE 9

| Interlayer | Causer Layer +Inhibitor (g/m$^2$) | Contrast (Y) Causer | Contrast (Y) Receiver | % Loss Causer | % Loss Receiver |
|---|---|---|---|---|---|
| | | Coating Set I | | | |
| gelatin | — | 1.58 | 0.98 | | |
| | | | | 68 | 60 |
| gelatin | +(0.08) | 0.51 | 0.39 | | |
| Polymer V | — | 1.56 | 0.91 | | |
| | | | | 70 | 35 |
| Polymer V | +(0.08) | 0.46 | 0.59 | | |
| Polymer Vd | — | 1.58 | 0.92 | | |
| | | | | 72 | 41 |
| Polymer Vd | +(0.08) | 0.45 | 0.54 | | |

TABLE 9-continued

| Interlayer | Causer Layer +Inhibitor (g/m$^2$) | Contrast (Y) Causer | Contrast (Y) Receiver | % Loss Causer | % Loss Receiver |
|---|---|---|---|---|---|
| | | Coating Set II | | | |
| gelatin | — | 1.56 | 1.06 | | |
| | | | | 70 | 69 |
| gelatin | +(0.08) | 0.46 | 0.32 | | |
| Polymer Vc | — | 1.59 | 1.04 | | |
| | | | | 67 | 40 |
| Polymer Vc | +(0.08) | 0.50 | 0.62 | | |
| | | Coating Set III | | | |
| gelatin | — | 1.60 | 1.05 | | |
| | | | | 61 | 63 |
| gelatin | +(0.06) | 0.62 | 0.38 | | |
| Polymer Va | — | 1.58 | 1.00 | | |
| | | | | 61 | 46 |
| Polymer Va | +(0.06) | 0.61 | 0.57 | | |
| Polymer Vb | — | 1.55 | 1.05 | | |
| | | | | 60 | 54 |
| Polymer Vb | +(0.06) | 0.64 | 0.48 | | |
| Polymer Ve | — | 1.60 | 1.04 | | |
| | | | | 62 | 58 |
| Polymer Ve | +(0.06) | 0.60 | 0.44 | | |

The invention has been described in detail with particular reference to preferred embodiments thereof, but it will be understood that variations and modifications can be effected within the spirit and scope of the invention.

We claim:

1. A photographic element comprising at least one silver halide emulsion layer in reactive association with a DIR compound and at least one barrier layer located between said silver halide emulsion layer and a second silver halide emulsion layer or between said silver halide layer and a solution for processing; said silver halide emulsion layer comprising a polymer comprised of repeating units of the formula —(A)— and —(B)— wherein A is derived from a hydrophobic ethylenically unsaturated monomer and B is derived from a hydrophillic ethylenically unsaturated monomer; wherein the polymer contains from about $1\times10^{-5}$ to about $4\times10^{-3}$ moles/gram of ion forming functional groups which are or form anionic acid salts or acid addition salts of primary amino groups such that the polymer layer reflects development inhibitor released from the DIR compound and allows the passage of solutions for processing the silver halide emulsion layer.

2. A photographic element comprising at least one layer comprising a silver halide emulsion in reactive association with a DIR compound and at least one barrier layer located between said silver halide emulsion layer and a second silver halide emulsion layer or between said silver halide layer and a solution for processing said silver halide emulsion layer comprising a polymer comprised of repeating units derived from a hydrophobic acrylate, methacrylate, acrylamide or methacrylamide monomer and repeating units derived from an ionic hydrophilic acrylate, methacrylate, acrylamide or methacrylamide monomer wherein the polymer contains from about $1\times10^{-5}$ to about $4\times10^{-3}$ moles/gram of ion forming functional groups which are or from anionic acid salts or acid addition salts of primary amino groups such that the polymer layer reflects development inhibitor released from the DIR compound and allows the passage of solutions for processing the silver halide emulsion layer.

3. The photographic element of claim 2 wherein the polymer is further comprised of repeating units derived from a non-ionic hydrophilic ethylenically unsaturated monomer.

4. The photographic element of claim 2, wherein the polymer comprises repeating units of the formula $$-(A)_m-(B)_n-$$

wherein

A is a repeating unit derived from a hydrophobic monomer the unit having the structure

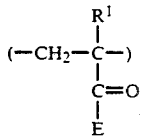

where $R^1$=—H or —$CH_3$;

m is 0 to 99.5 mole %;

E=—$OR^2$ or —$NR^3R^4$;

$R^2$=a substituted or unsubstituted straight, branched, or cyclic alkyl or aryl group of 1 to 10 carbon atoms;

$R^3$ and $R^4$ are independently selected from H or any $R^2$ group, and $R^3$ and $R^4$ together contain at least 3 carbon atoms;

wherein

B is a repeating unit derived from an ionic hydrophilic monomer the unit having the structure:

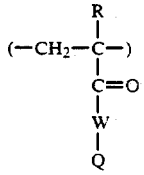

wherein

R=—H or —$CH_3$;

n=0.5 to 100 mole %:

W=—$OR^5$— or —$NR^6R^7$—;

$R^5$=—H or straight, branched, or cyclic alkylene or arylene groups of 1 to 10 carbon atoms;

$R^6$=—H or straight, branched, or cyclic alkyl or aryl groups from 1 to 6 carbon atoms;

$R^7$=straight, branched, or cyclic alkylene or arylene groups of 1 to 10 carbon atoms, and Q is an ion forming functional group independently selected from:

a) —$NH_2$ or the acid addition salt —$NH_2$:HX, where X is an acid anion, or b) —$CO_2M$, —$SO_3M$, —$OSO_3M$, and —O-$PO_3M$, where M is a cation;

and wherein the polymer contains from $1\times10^{-5}$ to $4\times10^{-3}$ grams/mole of ion forming functional groups.

5. The photographic element of claim 4 wherein the polymer is further comprised of repeating units derived from a non-ionic hydrophilic ethylenically unsaturated monomer.

6. The photographic element of claim 5 wherein the polymer is further comprised of repeating units derived from a non-ionic hydrophilic methacrylate, acrylate, acrylamide or methacrylamide monomer.

7. The photographic element of claim 4 wherein $R^2$ and $R^3$ are unsubstituted straight, branched or cyclic alkyl groups of 4 to 8 carbons and $R^4$ is an H and wherein $R^5$ and $R^7$ are straight, branched or cyclic alkylene groups of 3 to 8 carbons and $R^6$ is an H.

8. The photographic element of claim 4 wherein E is —$NR^3R^4$ and W is —$NR^6R^7$—.

9. The photographic element of claim 4 wherein

A is independently selected from the group of hydrophobic monomers consisting of N-isopropylacrylamide, N-t-butylacrylamide, N-butylacrylamide, N-t-butylmethacrylamide, N-(1,1-dimethyl-3-oxobutyl)-acrylamide, N-butylmethacrylate, 2-ethyl-hexylmethacrylate and benzylmethacrylate; and wherein B is independently selected from the group of hydrophilic ionic monomers consisting of N-(3-aminopropyl)methacrylamide hydrochloride, aminoethylmethacrylate hydrochloride, sulfo-ethyl methacrylate sodium salt, N-(2-sulfo-1, 1-dimethyl-ethyl-)acrylamide sodium salt and N-2-carboxyethylacrylamide.

10. The photographic element of claim 9 wherein the polymer is further comprised of a hydrophilic non-ionic monomer selected from the group consisting of acrylamide, methylene-bis-acrylamide and hydroxyethylmethacrylate.

11. The photographic element of any one of claims 1, 2, 4, and 9 wherein the polymer is cationic.

12. The photographic element of any one of claims 1, 2, 4 and 9 wherein the polymer contains about $5\times10^{-5}$ to $2\times10^{-3}$ moles/gram of ion forming functional groups.

13. The photographic element of claim 9 wherein A is N-t-butylacrylamide and B is N-(3-aminopropyl) methacrylamide hydrochloride.

14. The photographic element of any one of claims 1, 2, 4 and 9 wherein the polymer layer further comprises up to 25% gelatin.

15. The photographic element of any one of claims 1, 2, 4, and 9 wherein the DIR compound releases a development inhibitor containing a timing group.

16. The photographic element of anyone of claims 1, 2, 4 and 9 wherein the polymer layer is associated with a surfactant or surfactant-like compound.

17. The photographic element of claim 16 wherein the surfactant or surfactant-like compound has a charge opposite to that of the polymer contained in the polymer layer.

18. A method of forming a photographic image in an imagewise exposed photographic element of any one of claims 1, 2, 4, 9 and 15 comprising developing the photographic image by means of a color developing agent.

* * * * *

UNITED STATES PATENT AND TRADEMARK OFFICE

CERTIFICATE OF CORRECTION

PATENT NO. : 5,254,441

DATED : October 19, 1993

INVENTOR(S) : Glenn T. Pearce et al

It is certified that error appears in the above-indentified patent and that said Letters Patent is hereby corrected as shown below:

Col. 29, line 9, delete "from" and insert --form--.

Signed and Sealed this

Eleventh Day of October, 1994

Bruce Lehman

*Attest:*

BRUCE LEHMAN

*Attesting Officer*

*Commissioner of Patents and Trademarks*